US006484808B2

(12) United States Patent
Jones et al.

(10) Patent No.: US 6,484,808 B2
(45) Date of Patent: Nov. 26, 2002

(54) STRIPPER/PACKER

(75) Inventors: Donald L. Jones, Conroe, TX (US); David J. McWhorter, Magnolia, TX (US); Richard M. Ward, Conroe, TX (US)

(73) Assignee: Varco I/P, Inc., Houston, TX (US)

( * ) Notice: Subject to any disclaimer, the term of this patent is extended or adjusted under 35 U.S.C. 154(b) by 20 days.

(21) Appl. No.: 09/742,070

(22) Filed: Dec. 20, 2000

(65) Prior Publication Data

US 2002/0074131 A1 Jun. 20, 2002

Related U.S. Application Data

(60) Provisional application No. 60/210,253, filed on Jun. 9, 2000.

(51) Int. Cl.[7] ..... E21B 33/12; E21B 19/00; E21B 33/08

(52) U.S. Cl. ..... 166/379; 166/387; 277/323; 277/343

(58) Field of Search ..... 166/84.2, 84.4, 166/85.3, 377, 379, 387; 277/328, 329, 330, 323, 343

(56) References Cited

U.S. PATENT DOCUMENTS 3,468,549 A * 9/1969 Wilson ..... 166/84.2
4,923,005 A * 5/1990 Laky et al. ..... 166/335
5,566,753 A * 10/1996 Van Winkle et al. ..... 166/84.1

* cited by examiner

*Primary Examiner*—David Bagnell
*Assistant Examiner*—Brian Halford
(74) *Attorney, Agent, or Firm*—Browning Bushman P.C.

(57) ABSTRACT

A stripper/packer includes first and second packing elements, which are interchangeable to alleviate inventory concerns. The upper actuating hydraulic piston is the same diameter as the lower piston, which allows the operator to utilize the same amount of pressure to maintain a seal during transition between packing elements. Both packing elements are separately actuated from the lower side allowing the wellbore pressure to assist the seal.

14 Claims, 3 Drawing Sheets

STRIPPER/PACKER

This application claims the benefit of Provisional patent application Ser. No. 60/210,253 filed Jun. 9, 2000.

FIELD OF THE INVENTION

The present invention relates generally to the field of stripper/packers on well heads.

BACKGROUND OF THE INVENTION

A known stripper/packer shown in FIG. 1 has one packing element and a hydraulically actuated window that closes downwardly to provide access to the packer element so that a worn packer element can be replaced. The upper region of the stripper/packer includes a significant amount of wasted space, in which guide bushings must be provided to contain coiled tubing as it is guided through the stripper/packer.

The stripper/packer is installed to contain wellbore pressure and fluids during coiled tubing operations. The stripper/packer provides a means to effect a dynamic seal around moving tubing. A seal is accomplished by an annular packing element being adjustably compressed around the tubing by a hydraulic piston.

As coiled tubing moves through the stripper/packer in contact with the packer element, it wears away the material of the packing element. Thus, the working lifetime of the packing element is of primary concern to operators of coiled tubing systems. The packing element must be replaced when frictional wear has abraded the material to a point that a seal can no longer be accomplished. When the packing element is worn to the point where it can no longer hold a seal (and preferably before this occurs), the packing element must be replaced.

To increase the time between packing element changes, operators have employed two stripper/packers mounted in tandem, effectively doubling the time between packing element changes. The disadvantages of using two stripper/packers are readily apparent, including such drawbacks as added weight, length, and cost. Furthermore, only the upper stripper/packer can be used when snubbing the coiled tubing (i. e. inserting the coiled tubing into the hole) because the coiled tubing typically buckles under compressive stress if the lower stripper/packer is used.

Thus, there remains a need for a stripper/packer which includes two independently replaceable packing elements in the same form factor which currently retains a single packing element.

SUMMARY OF THE INVENTION

The present invention addresses this need in the art by adding a second packing element within the same stripper/packer. This invention provides a second packing element, which is interchangeable with the first packing element, thereby minimizing inventory concerns. The actuating hydraulic piston is the same diameter as the lower piston, which allows the operator to utilize the same amount of pressure to maintain a seal during transition between packing elements. Both packing elements are separately actuated from the lower side allowing the wellbore pressure to assist the seal.

In another aspect of the present invention, operators will sometimes allow wellbore fluid to leak by to lubricate the packing element in an effort to extend packer element life. This invention allows the operator to separately apply a small amount of pressure to the upper packing element to act as a wiper and allow the wiped fluid to be collected through the wellbore access port to alleviate environment concerns.

Thus, the present invention provides two independently replaceable packing elements in the same size body as previously used for a single packing element. This structure save size and weight associated with coupling two stripper/packers in tandem. Further, because the upper portion of the stripper/packer body includes a packing element, the upper element can be effectively used during snubbing operations without concern that the coiled tubing will buckle.

These and other features of the present invention will be apparent to those skilled in the art from a review of the following description along with the accompanying drawings.

DETAILED DESCRIPTION OF A PREFERRED EMBODIMENT

Figure 1:
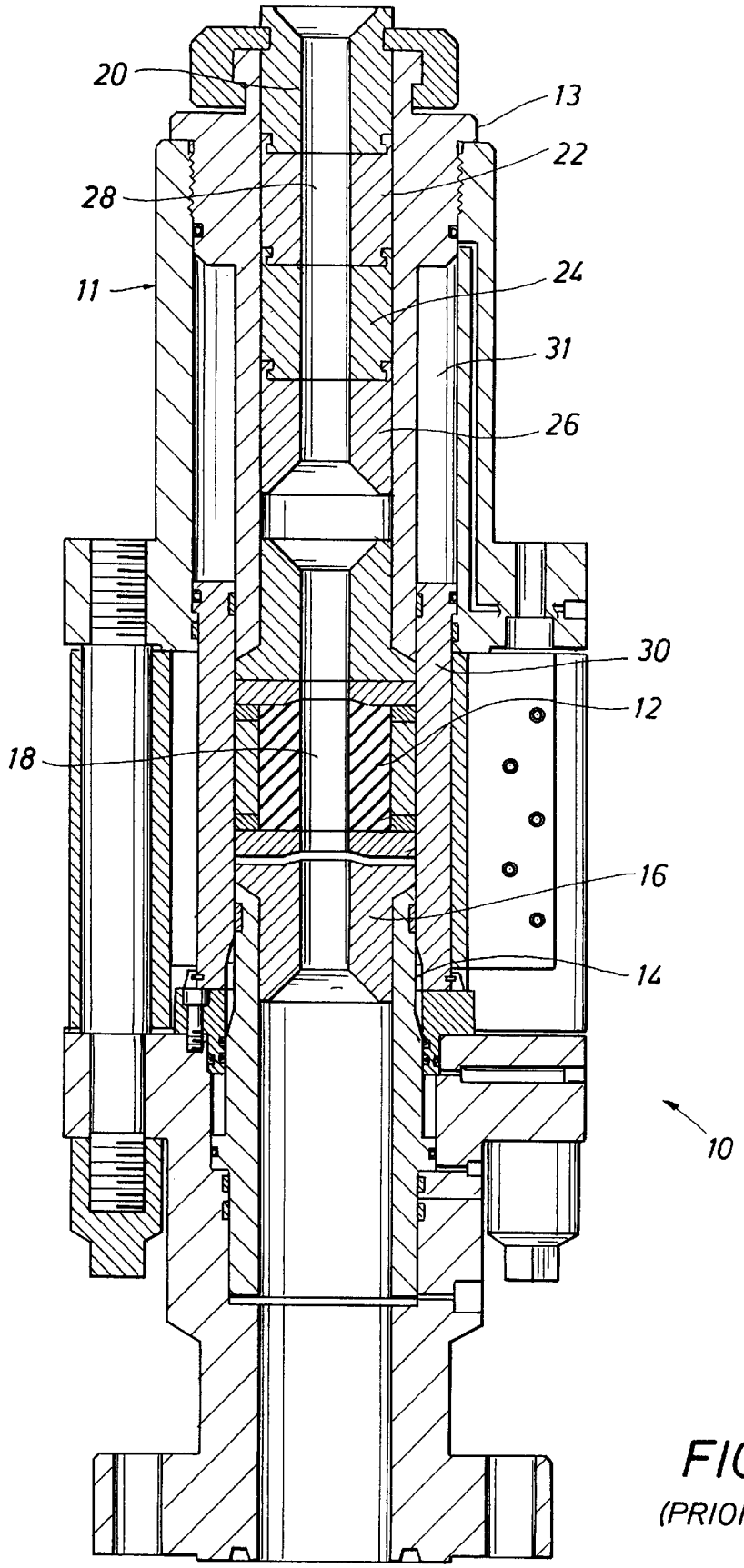
FIG.1 (PRIOR ART)
FIG. 1 is a side section view of a prior art stripper/packer.

Referring first to FIG. 1, a known stripper/packer 10 is illustrated. The stripper/packer 10 includes a packer element 12 which is compressed by upward motion of a piston 14 pushing against a lower bushing 16. This action compresses the packer element 12, causing it to bulge inwardly and compress against a coiled tubing (not shown) in a bore 18 of the stripper packer.

The stripper/packer 10 also includes an upper guide comprising a top bushing 20, a first guide bushing 22, a second guide bushing 24, and a bottom bushing 26. The upper guide directs the coiled tubing (not shown) through a bore 28 down into the packer element 12.

The stripper/packer 10 further includes an access window 30 which moves upwardly under hydraulic pressure to provide access to replace the packer element 12 when it is worn. The access window 30 moves into an annular chamber 31 defined by an upper body 11 and a hydraulic cap 13. The access window 30 is raised to provide access to replace the single packer element 12 when it is worn or damaged.

Figure 2:
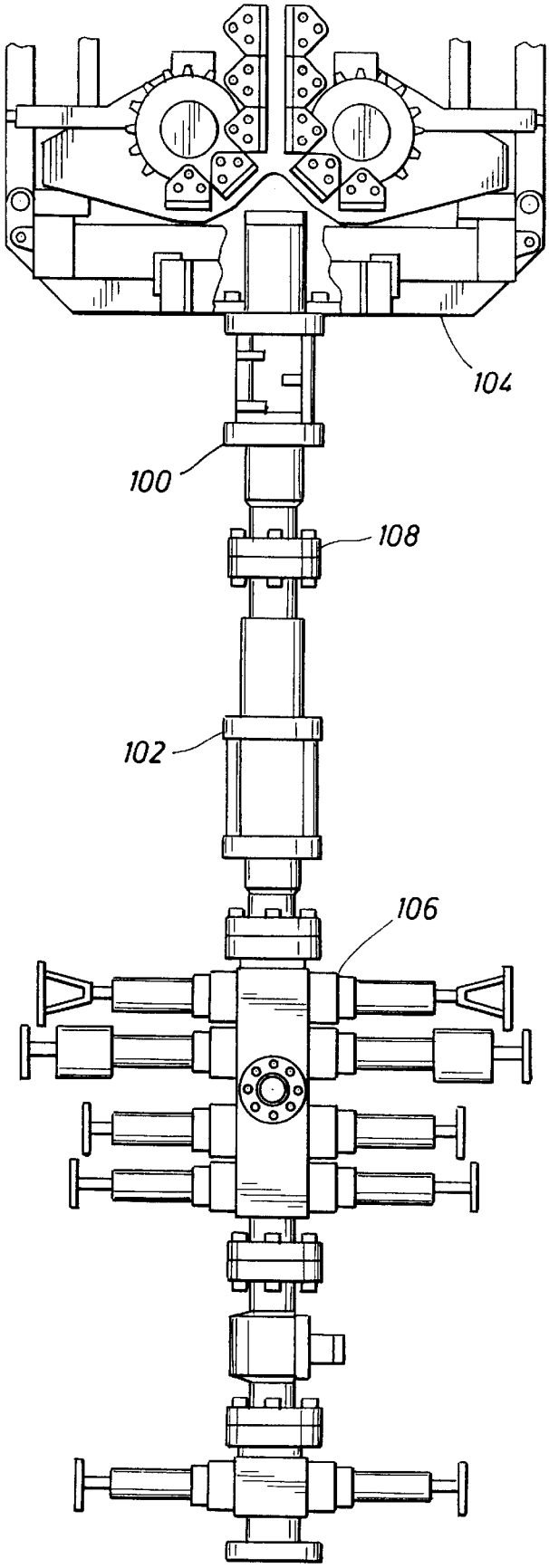
FIG. 2 (PRIOR ART)
FIG. 2 is a side elevation view of a prior art tandem arrangement of a primary and a secondary stripper/packer.

In order to provide primary and secondary stripper/packers, such devices are often mounted in tandem, one on top of the other at the wellhead, as shown in FIG. 2. The structure of FIG. 2 illustrates a primary stripper/packer 100 mounted over a secondary stripper/packer 102. The tandem combination of stripper/packers 100 and 102 are mounted beneath a known coil tubing injector 104 and directly atop a known blowout preventor 106, which are shown in FIG. 2 schematically by way of example. The stripper/packers are joined together at a flanged coupling 108.

While such an arrangement successfully provides a secondary stripper/packer as desired, coil tubing cannot be snubbed into the hole while using only the lower or secondary stripper/packer because the coil tubing tends to buckle or kink between the coil tubing injector 104 and the secondary stripper/packer 102 where the coil tubing has insufficient lateral support. It should also be immediately apparent from a cursory view of the structure of FIG. 2 that the overall length and weight of the structure are significantly increased by the inclusion of the secondary stripper/packer. The present invention addresses these and other problems in the art.

Figure 3:
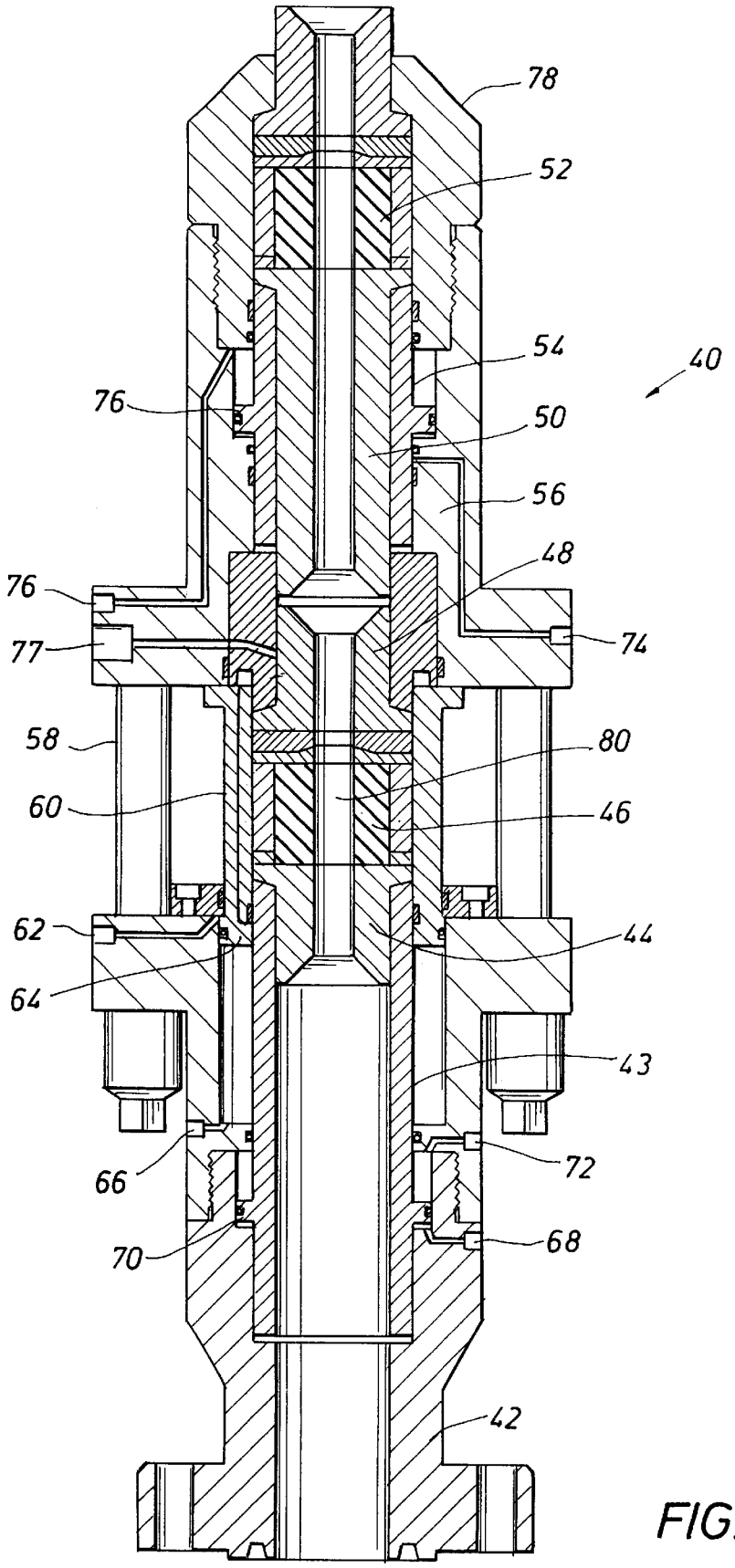
FIG. 3 is a side section view of a stripper/packer constructed in accordance with the invention.

FIG. 3 shows a stripper/packer 40 of the invention. The stripper/packer 40 is mounted to a wellhead (not shown) at a lower body 42. Slidably mounted within the body 42 is a lower piston 43 which mates with a lower bushing 44. The lower bushing 44 engages the underside of the compressible lower packer element 46 which is mounted in abutting contact with a lower intermediate bushing 48. Continuing up the stripper/packer 40, an upper intermediate bushing 50 engages the underside of an upper packer element 52 which is actuated by an upper piston 54.

An upper body 56 is secured to the lower body 42 by a set of bolts 58. The upper piston 54 is slidably mounted within the upper body 56.

The stripper/packer 40 is also provided with an access window 60 to provide access for replacing the lower packer element 46. To open the access window 60, hydraulic pressure is applied to a window open port 62, which ports pressure on the top of a window piston 64, moving the access window down. After the packing element has been replaced, hydraulic pressure is applied to a window close port 66, which ports pressure on the bottom of the piston 64, thereby closing the access window.

To actuate the lower packer element 46, hydraulic pressure is applied to a lower pack 10 offport 68, which ports pressure to the underside of a piston flange 70 which is integral with the lower piston 43. This forces the bushing 44 up to compress the lower packer element 46, thereby packing off coiled tubing within a bore 80. To decompress the lower packer element 46, hydraulic pressure is applied to a lower piston retract port 72, which ports pressure on top of the piston flange 70.

To actuate-the upper packer element 52, hydraulic pressure is applied to an upper pack-off part 74, which applies pressure to the underside of an upper piston flange 80, thereby compressing the upper packer element 52. To decompress the upper packer element 52, hydraulic pressure is applied to an upper piston retract port 76. Thus, both the lower packer element 44 and the upper packer element 52 are actuated from below the packer element, another feature of the present invention.

A wellbore access port 77 is also provided. A wellbore access port 77 is typically provided in a blowout preventer as a telltale for the indication of leakage by a packer element, and the wellbore access port 77 does indeed provide indication for leakage by the lower packer element 44. However, in the present invention, the wellbore access port provides an additional feature. An operator may choose to provide a nominal leakage for the lubrication of the upper packer element 52. In this event, the wellbore access port 77 serves the additional function of a drain path for the lubricating fluid from between the lower intermediate bushing 48 and the upper intermediate bushing 50, i.e. between the packer elements.

Finally, in order to replace the upper packer element 52, the stripper/packer 40 is provided with an upper cap 78 which encloses the upper packer element, and removing the upper cap brings along with it the upper packer element. Thus, it should be noted that the two packer elements 46 and 52 are independent of one another, and that each can be replaced without disturbing the other. Also, the packer elements 46 and 52 are identical in structure, so that they can be interchanged, thus reducing inventory overhead. Further, significant space is saved by including an upper packer element 52 is space that would other wise be occupied by the upper and lower guide bushings 22 and 24, respectively, and top and bottom bushings 20 and 26, respectively, shown in FIG. 1.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A stripper/packer comprising:

a. a lower body defining an axis;

b. an upper body joined to and co-axial with the lower body;

c. a co-axial bore through the lower and the upper bodies;

d. a lower piston slidably mounted within the lower body;

e. a lower packer element actuated by the lower piston;

f. an upper piston slidably mounted within the upper body;

g. an upper packer element actuated by the upper piston; and h. an access window between the upper body and the lower body, adapted to provide access to the lower packer element, wherein the access window is in abutting contact with the upper body when the access window is shut and wherein the access window retracts into the lower body when the window is open.

2. The stripper/packer of claim 1, further comprising an upper cap engageable with the upper body to retain the upper packer element, the upper cap adapted to provide access to the upper packer element.

3. The stripper/packer of claim 1, wherein the access window moves in a downward direction to provide access to the lower packer element.

4. The stripper/packer of claim 1, further comprising a lower bushing between the lower piston and the lower packer element.

5. The stripper/packer of claim 1, further comprising an upper intermediate bushing between the upper piston and the upper packer element.

6. The stripper/packer of claim 1, further comprising:

a. a lower intermediate bushing above the lower packer element;

b. an upper intermediate bushing below the upper packer element; and c. a wellbore access port adapted to drain fluid from between the lower intermediate bushing and the upper intermediate bushing.

7. The stripper/packer of claim 1, further comprising a wellbore access port adapted to drain fluid from between the upper and lower packer elements.

8. The stripper/packer of claim 1, wherein the upper packer element is actuated by moving the upper piston in a vertically upward direction.

9. The stripper/packer of claim 1, wherein the lower packer element is actuated by moving the lower piston in a vertically upward direction.

10. The stripper/packer of claim 1, wherein the upper packer element is actuated by moving the upper piston in a vertically upward direction and the lower packer element is actuated by moving the lower piston in a vertically upward direction.

11. The stripper/packer of claim 1, further comprising:

a. a lower set of hydraulic ports to actuate the lower packer element; and b. an upper set of hydraulic ports to actuate the upper packer element.

12. The stripper/packer of claim 1, wherein the upper and lower packer elements are interchangeable.

13. The stripper/packer of claim 1, wherein the upper piston defines a diameter, and further wherein the lower piston defines the same diameter.

14. A method of replacing a packer element selected from a lower packer element and an upper packer element in a dual packer element stripper/packer, comprising the steps of:

a. providing a lower packer element within a lower body, the lower packer element accessible through a hydraulically actuated access window;

b. providing an upper packer element within an upper body, the upper packer element accessible by removal of an upper cap from the upper body, wherein the access window is in abutting contact with the upper body when the access window is shut and wherein the access window retracts into the lower body when the window is open;

c. replacing the lower packer element through the access window independent of the upper packer element; and d. replacing the upper packer element, gaining access to the upper packer element by removing the upper cap from the upper body independent of the lower packer element.

* * * * *